US007691256B2

(12) United States Patent
Montanari et al.

(10) Patent No.: US 7,691,256 B2
(45) Date of Patent: Apr. 6, 2010

(54) PROCESS FOR THE CONVERSION OF HEAVY CHARGES SUCH AS HEAVY CRUDE OILS AND DISTILLATION RESIDUES

(75) Inventors: Romolo Montanari, Milan (IT); Mario Marchionna, Milan (IT); Sergio Rosi, Milan (IT); Nicoletta Panariti, Lecco (IT); Alberto Delbianco, Milan (IT)

(73) Assignees: ENI S.p.A., Rome (IT); SNAMPROGETTI S.p.A., San Donato Milanese (IT); ENITECNOLOGIE S.p.A., San Donato Milanese (IT)

( * ) Notice: Subject to any disclaimer, the term of this patent is extended or adjusted under 35 U.S.C. 154(b) by 1054 days.

(21) Appl. No.: 11/311,147

(22) Filed: Dec. 20, 2005

(65) Prior Publication Data

US 2006/0157385 A1 Jul. 20, 2006

(30) Foreign Application Priority Data

Dec. 22, 2004 (IT) ..... MI2004A2445

(51) Int. Cl.

| | |
|---|---|
| ***C10G 65/14*** | (2006.01) |
| ***C10G 49/22*** | (2006.01) |
| ***C10G 45/00*** | (2006.01) |
| ***C10C 3/08*** | (2006.01) |

(52) U.S. Cl. ..... 208/78; 208/45; 208/86; 208/100; 208/143

(58) Field of Classification Search ..... 208/39–46, 208/49, 58, 59, 78, 95, 100–105, 142, 143, 208/85–87

See application file for complete search history.

(56) References Cited

U.S. PATENT DOCUMENTS 3,816,295 A * 6/1974 Coleman et al. ..... 208/86

(Continued)

FOREIGN PATENT DOCUMENTS

WO WO 2004/056947 A1 7/2004

OTHER PUBLICATIONS

U.S. Appl. No. 11/311,134, filed Dec. 20, 2005, Montanari, et al.

(Continued)

*Primary Examiner*—Glenn Caldarola
*Assistant Examiner*—Randy Boyer
(74) *Attorney, Agent, or Firm*—Oblon, Spivak, McClelland, Maier & Neustadt, L.L.P.

(57) ABSTRACT

Heavy hydrocarbon charges are converted in a deasphalting section in the presence of solvents and obtaining two streams, one consisting of deasphalted oil and the other one containing asphaltenes, mixing the deasphalted oil stream with a hydrogenation catalyst and passing the thus obtained mixture to a hydroprocessing section containing hydrogen or hydrogen/$H_2S$, mixing the stream consisting of asphaltenes discharged from the deasphalting section with an appropriate hydrogenation catalyst and passing the obtained mixture to a second hydroprocessing section where it is reacted with hydrogen or a mixture of hydrogen and $H_2S$, passing both the stream containing the reaction product with dispersed catalyst from the hydroprocessing section and the stream containing the reaction product with dispersed catalyst from the second hydroprocessing section, to one or more distillation or flash stages, whereby the more volatile fractions are separated from the distillation residue (tar) or from the liquid discharged from the flash unit, sending the distillation residue (tar) or the liquid discharged from the flash unit, containing the catalyst in the dispersed phase, with a high content of metal sulphides, produced by demetallization of the charge, to a second deasphalting section thereby obtaining deasphalted oil and asphaltenes.

40 Claims, 1 Drawing Sheet

U.S. PATENT DOCUMENTS

Figure 1:
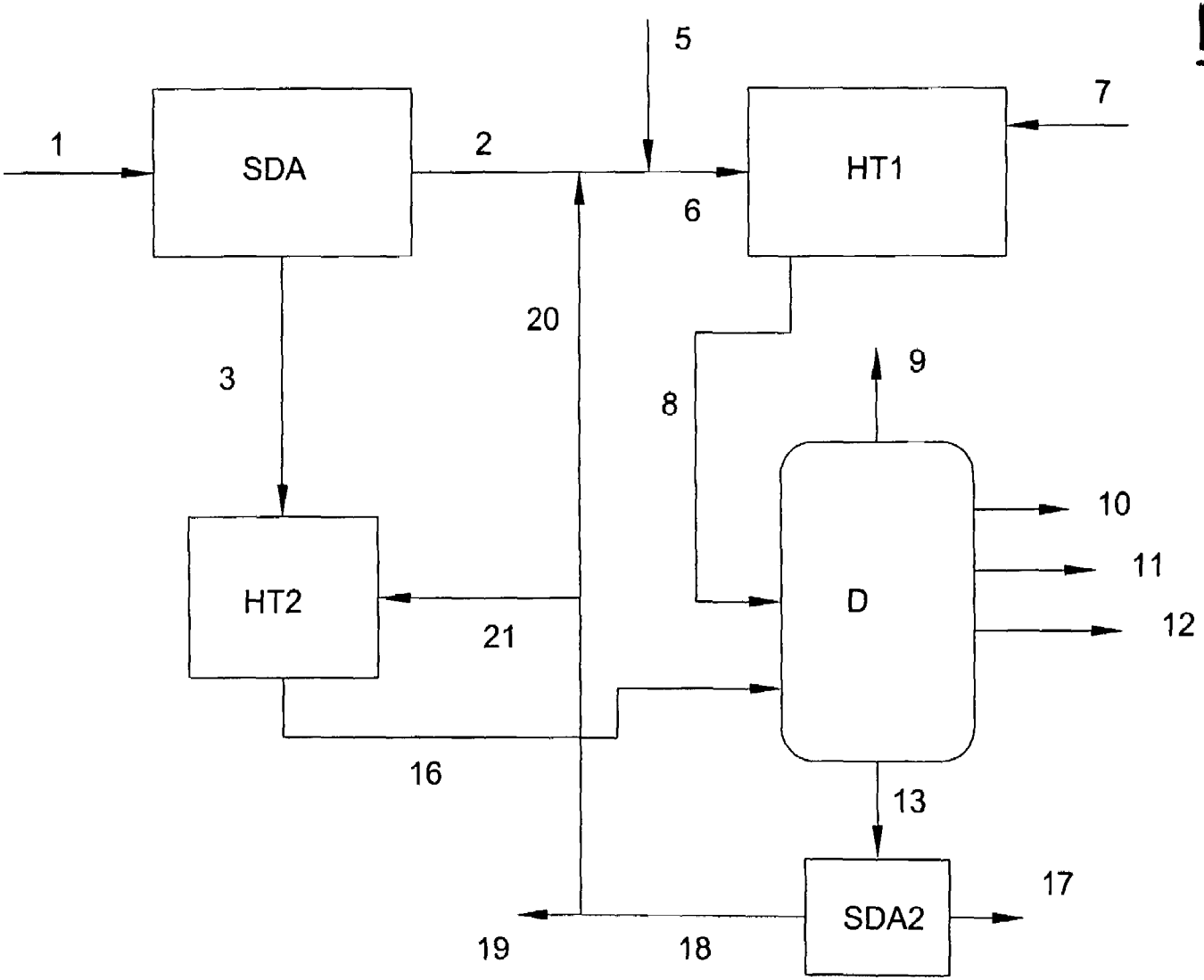

| | | | | |
|---|---|---|---|---|
| 4,126,538 | A | 11/1978 | Goudriaan et al. | |
| 4,334,976 | A * | 6/1982 | Yan | 208/97 |
| 4,686,028 | A * | 8/1987 | Van Driesen et al. | 208/86 |
| 5,124,026 | A * | 6/1992 | Taylor et al. | 208/86 |
| 5,932,090 | A | 8/1999 | Marchionna et al. | |
| 2003/0089636 | A1 | 5/2003 | Marchionna et al. | |
| 2004/0163996 | A1 | 8/2004 | Colyar | |

OTHER PUBLICATIONS

U.S. Appl. No. 10/538,886, filed Jun. 14, 2005, Montanari, et al.
U.S. Appl. No. 10/539,058, filed Jun. 15, 2005, Montanari, et al.
U.S. Appl. No. 11/404,746, filed Apr. 17, 2006, Marchionna, et al.
U.S. Appl. No. 12/248,163, filed Oct. 9, 2008, Marchionna, et al.
U.S. Appl. No. 12/375,615, filed Jan. 29, 2009, Marchionna, et al.
U.S. Appl. No. 12/375,610, filed Jan. 29, 2009, Marchionna, et al.

* cited by examiner

PROCESS FOR THE CONVERSION OF HEAVY CHARGES SUCH AS HEAVY CRUDE OILS AND DISTILLATION RESIDUES

BACKGROUND OF THE INVENTION

Field of the Invention

The present invention refers to a process for the conversion of heavy charges, among which there are the heavy and extra heavy crude oils, bitumen from "oil sands", and the distillation residues, using at least three process units: deasphalting, hydroconversion of the charge using a catalyst in the dispersed phase and distillation.

The conversion of heavy crude oils, bitumen from "oil sands" and oil residues into liquid products can essentially be done in two ways: one is exclusively a thermal way, the other is by means of a hydrogenation treatment.

At present all the studies are mainly addressing the hydrogenation treatments because the thermal processes have problems related to the disposal of the sub products, in particular sub products such as coke (obtained in quantities even higher than 30% in weight relative to the charge) and to the low quality of the conversion products.

The hydrogenation processes consist in processing the charge in presence of hydrogen and suitable catalysts.

The hydrogenation processes now being commercialized use fix bed or ebullated bed reactors and employ catalysts which generally consist of one or more transition metals (Mo, W, Ni, Co, Ru, etc.) supported on silica/alumina (or equivalent material).

The fixed bed technologies have considerable problems in processing particularly heavy charges containing high percentages of etheroatoms, metals and asphaltenes, because said contaminants lead to a quick deactivation of the catalyst.

To process said charges, ebullated bed technologies were developed having interesting performances, but are complex and expensive.

The hydroprocessing technologies operating with catalysts in the dispersed phase may be an attractive solution to the problems found using the fixed or ebullated bed technologies. The slurry processes, indeed, combine the advantage of an ample flexibility with respect to the charges with high performances in terms of conversion and upgrading, turning out to be, at least in principle, much simpler from a technological point of view.

The slurry technologies are characterized by the presence of catalyst particles having very small average dimensions and being efficiently dispersed in the medium: due to this the hydrogenation processes become easier and immediate in every part of the reactor. The formation of coke is considerably reduced and the charge upgrading is high.

The catalyst can be introduced as powder of sufficiently small dimensions (U.S. Pat. No. 4,303,634) or as a soluble precursor (U.S. Pat. No. 5,288,681). In said latter case the active form of the catalyst (generally a sulphide of the metal) is formed in-situ by thermal decomposition of the used compound, during the reaction itself or after an appropriate pretreatment (U.S. Pat. No. 4,470,295).

The metals that make up the dispersed catalysts are generally one or more transition metals (preferably Mo, W, Ni, Co or Ru). Molybdenum and tungsten have definitely more satisfactory performances than nickel, cobalt or ruthenium or even more than vanadium or iron (N. Panariti et al., Appl. Catal. A: Gen. 2000, 204, 203).

The use of dispersed catalysts, even when solving the majority of problems found in the above described technologies, presents, however, some drawbacks that are mainly related to the life cycle of the catalyst itself and to the quantity of obtained products.

The way of use of said catalysts (type of precursors, concentration, etc.) has indeed a high importance both from the economic point of view and the environmental impact.

The catalyst may be used at a low concentration (few hundredths of ppm) in a "once-through" arrangement, but in such case the upgrading of the products turns out to be insufficient (N. Panariti et al., Appl. Catal. A: Gen. 2000, 204, 203 and 215). By operating with very active catalysts (for instance molybdenum) and with higher catalyst concentrations (thousands of ppm of metal), the quality of the product improves, but it becomes necessary to recycle the catalyst.

The catalyst coming out of the reactor can be recovered by separation from the product obtained from the hydroprocessing (preferably from the bottom of the distillation column downstream from the reactor) by means of conventional methods such as, for instance, settling, centrifugation or filtration (U.S. Pat. No. 3,240,718; U.S. Pat. No. 4,762,812). Part of said catalyst can be recycled to the hydrogenation process without further processing. However, the catalyst recovered using the known hydroprocesses normally has a reduced activity compared to the fresh catalyst. Therefore, it is necessary to have an appropriate regeneration stage in order to restore the catalytic activity and recycle at least part of said catalyst to the hydroprocessing reactor. Moreover, said processes of catalyst recovery are expensive, as well as being extremely complex from a technological point of view.

Concerning the chemical description of the conversion processes, it is very useful to introduce the concept of stability which, for a crude oil or an oil residue, refers to its tendency to precipitate its asphaltenic component because of a change in the operational conditions or in the chemical composition of the oil and/or of the asphaltenes (incompatibility), following a dilution with hydrocarbon cutters, or a chemical transformation induced by processes of cracking, hydrogenation, etc.

Conventionally, those hydrocarbons, which can be precipitated from a crude oil or from an oil residue by means of processing them with a paraffinic hydrocarbon with a number of carbon atoms from 3 to 7, are defined as asphaltenes, for instance n-heptane in the standard conditions as described in norm IP-143.

Qualitatively, it is possible to state that the incompatibility instances occur when a mixture is made with products having very different characteristics in the nature of their maltenic or non asphaltenic component as is the case in mixing paraffinic crude oils with aromatic crude oils or in the dilution of cutter stock of paraffinic nature (a typical case is the fluxing of tar from visbreaking with diesel oils of low aromatic level).

In the processes of distillation conversion of crude oil residues, bitumens coming from "oil sands" and heavy or extra heavy crude oils, the maximum level of conversion is limited by the stability of the product residue. Said processes, indeed, modify the chemical nature of the oils and asphaltenes, causing a progressive decrease of the stability when the level of the modifications is increased. Beyond a certain limit, the asphaltenes in the charge may undergo a phase separation (or precipitate) and therefore trigger a coke formation process.

From the chemio-physical point of view, the occurrence of phase separation is explained by the fact that when the conversion reactions progress, the asphaltenic phase becomes more and more aromatic because of the dealkylization and condensation reactions.

Therefore, beyond a certain level, the asphaltenes are no longer soluble in the maltenic phase also because, in the meantime, the latter has become more "paraffinic".

The control of loss of stability of a heavy charge during a thermal and/or catalytic conversion process is therefore essential to obtain the highest degree of conversion without having problems of coke formation or fouling.

In the "once through" processes the optimum operational conditions (essentially the reaction temperature and the residence time) are simply determined by the stability data of the effluent from the reactor by means of direct measurements on the non-converted residue (P value, Hot Filtration Test, Spot Test, etc.).

All said processes allow the achievement of higher or lower conversion levels according to the charge or to the type of used technology, but, anyway, generate a non converted residue, which we will call tar, at the border of instability which may vary, from case to case, from 30 to 85% of the initial charge. Said product is used to produce fuel oil, bitumens or can be used as a charge in the gasification processes.

Various schemes have been proposed, comprising the recycling in the cracking unit of more or less significant shares of tar, to increase the overall conversion level in the residue cracking processes.

In case of hydroconversion processes with dispersed catalysts in slurry phase, the tar recycling also permits the recovery of the catalyst, insomuch as the petitioners themselves have described in their petition IT-95A001095 a process which permits the recycling of the recovered catalyst to the hydroprocessing reactor without the need of a further stage of regeneration, obtaining in the meantime a good quality product without residue production ("zero residue refinery").

Said process comprises the following stages:

- mixing the heavy crude oil or the distillation residue with an appropriate hydrogenation catalyst and feeding the obtained mixture into a hydroprocessing reactor and introducing into it hydrogen or a mixture containing hydrogen and $H_2S$;
- feeding the stream containing the product of the hydroprocessing reaction and the catalyst in the dispersed phase into a distillation zone, in which the most volatile fractions are separated;
- feeding the high boiling fraction obtained in the distillation stage to a deasphalting stage, consequently obtaining two streams, one made up of deasphalted oil (DAO), the other one made up of asphalt, the catalyst in the dispersed phase and possibly containing coke and enriched by the metals coming from the initial charge.
- recycling to the zone of hydroprocessing at least 60%, possibly 80%, of the stream made up of asphalt, the catalyst in the dispersed phase and possibly containing coke, with a high content of metal.

Said petitioners have described, in the subsequent petition IT-MI2001A001438, process configurations different from the one described above.

The therein claimed process by means of the joint use of the following three process units: hydroconversion with catalysts in slurry phase (HT), distillation or flash (D), deasphalting (SDA), is characterized by the fact that the three units operate on mixed streams made up of fresh charge and recycle streams, by means of the following stages:

- feeding at least a fraction of the heavy charge into a section of deasphalting (SDA) in presence of solvents, obtaining two streams, one made up of deasphalted oil (DAO), the other of asphalts;
- mixing the asphalt with an appropriate hydrogenation catalyst and possibly with the remaining fraction of heavy charge not fed to the deasphalting section and feeding the obtained mixture to a hydroprocessing reactor (HT) and introducing into it hydrogen or a mixture containing hydrogen and $H_2S$;
- feeding the stream containing the product of the hydroprocessing reaction and the catalyst in the dispersed phase to one or more distillation of flash (D) stages, thus obtaining the separation of the most volatile fractions, among them the gases produced by the hydroprocessing reaction;
- recycling to the deasphalting zone at least 60% in weight of the distillation residue (tar) or of the liquid effluent from the flash unit, containing the catalyst in the dispersed phase, with a high content of metal sulphides, produced by the demetallization of the charge, and possibly containing coke.

Through said configurations the following advantages can be obtained:

- maximization of the efficiency of conversion in distillable products (derivates of distillation both at atmospheric pressure and in vacuum), and in deasphalted oil (DAO), which in most cases can be higher than 95%;
- maximization of the degree of upgrading of the charge, that is the removal of the existing poisons (metals, sulphur, nitrogen, carbon residue), minimizing the coke production;
- maximum flexibility in dealing with charges different in the nature of the hydrocarbon component (density) and in the level of pollutants;
- possibility of completely recycling the hydrogenation catalyst without the need of regeneration.

The treatment of a heavy hydrocarbon charge by means of Solvent Deasphalting permits the separation of two pseudo-components conventionally defined as Deasphalted Oil (DAO) and asphaltenes Cn (where n represents the number of carbon atoms in the paraffin used for Deasphalting (normally from 3 to 6).

SUMMARY OF THE INVENTION

We have surprisingly found that processing the two streams coming out of the deasphalting unit, DAO and asphaltenes, with two separate hydroprocesses performed in different conditions, allows one to obtain conversion and upgrading levels higher than those obtainable when processing the charge in its current state in optimal conditions.

The process, object of the present invention, for the conversion of heavy charges by means of the joint use of at least three of the following process units: deasphalting (SDA), hydroconversion with catalysts in slurry phase (HT1), distillation or flash (D), is characterized by the fact of comprising the following stages:

sending the heavy charge to a deasphalting section (SDA1) in presence of solvents, obtaining two streams: one made up of deasphalted oil (DAO 1 from SDA1), the other one containing asphaltenes;

mixing the stream made up of deasphalted oil (DAO1 from SDA1) with an appropriate hydrogenation catalyst and sending the thus obtained mixture to a hydroprocessing section (HT1) and introducing into it hydrogen or a mixture containing hydrogen and $H_2S$;

mixing the stream made up of asphaltenes coming out of the deasphalting section (SDA1) with an appropriate hydrogenation catalyst and sending the thus obtained mixture to a second hydroprocessing section (HT2) and introducing into it hydrogen or a mixture containing hydrogen and $H_2S$;

sending both the stream containing the product of the hydroprocessing section (HT1) and the catalyst in the dispersed phase, and the stream containing the reaction product of the second hydroprocessing section (HT2) and the catalyst in the dispersed phase to one or more distillation or flash stages (D) in which the most volatile fractions are separated. Among those fractions are the gases produced in the two hydroprocessing reactions (HT1 and HT2), from the distillation residue (tar) or from the liquid coming out of the flash unit;

sending the distillation residue (tar) or the liquid coming out of the flash unit, containing the catalyst in the dispersed phase, with a high content of metal sulphides and possibly containing coke, produced because of the demetallization of the charge, to a second deasphalting section (SDA2), in presence of solvents, obtaining two streams, one made up of deasphalted oil (DAO 2 from SDA2), the other one made up of asphaltenes of which, unless there is a drainage, a part is recycled to the hydroprocessing section (HT1) and the other one is recycled to the second hydroprocessing section (HT2).

DETAILED DESCRIPTION OF THE PREFERRED EMBODIMENTS

The heavy charges may be of different nature: they can be chosen among heavy and extra-heavy crude oils, distillation residues, "heavy oils" coming from catalytic processes, for instance "unconverted oils" from fixed or ebullated bed hydroprocessing, "heavy cycle oils" from catalytic cracking processes, "thermal tars" (coming for instance from visbreaking or similar thermal processes), bitumen from "oil sands", "coals" of various nature and any other high boiling charge of hydrocarbon origin generally known in the art with the name "black oils".

In particular, the weight ratio between the part recycled to the hydroprocessing section (HT1) and the part recycled to the second hydroprocessing section (HT2) is preferably in the range from 8/1 and 1/1, more preferably from 4/1 to 2/1 and most preferably about equal to 3/1.

The catalysts used in the two hydroprocessing stages (HT1 and HT2) can be chosen among those obtainable from easily decomposing oil-soluble precursors (metal naphtenates, metal derivates of phosphonic acids, metalcarbonyls, etc.) or among preformed compounds based on one or more transition metals such as Ni, Co, Ru, W and Mo: the latter is preferred due to its high catalyst activity.

It is preferable to use the same type of catalyst in both the hydroprocessing stages (HT1 and HT2).

The catalyst concentration, defined on the basis of the concentration of the metal or metals present in the hydroprocessing reactors (HT1 and HT2), is in the range from 350 to 100000 ppm, preferably from 5000 to 30000 ppm, more preferably from 8000 to 15000 ppm.

The hydroprocessing stage (HT1) is preferably maintained at a temperature in the range from 380 to 470° C., preferably from 390 to 440° C., and at a pressure ranging from 3 to 30 MPa, preferably from 10 to 20 MPa.

The second hydroprocessing stage (HT2) is preferably performed at temperature from 360 to 450° C., preferably from 390 to 420° C., and at a pressure from 3 to 30 MPa, preferably from 10 to 20 MPa.

The reactor, which can operate either in down-flow and, preferably, in up-flow mode, is fed with hydrogen. Said gas can be fed to the reactor in different sections.

The distillation stages are operated preferably at low pressure in the range from 0.001 to 0.5 MPa, preferably from 0.01 to 0.3 MPa.

The hydroprocessing stage (HT1) and the second hydroprocessing stage (HT2) can be made up of one or more reactors operating in the above described range of conditions. A part of the distillates produced in the first reactor can be recycled to the following reactors in the same stage.

The deasphalting stage (SDA1), performed by means of an extraction with a hydrocarbon or non-hydrocarbon solvent, is generally performed at temperatures in the range from 40 to 200° C. and at a pressure from 0.1 to 7 MPa.

Said stage can also be formed by one or more sections operating with the same solvent or with different solvents; the recovery of the solvent can be performed in multiple stages in sub-critical conditions or in supercritical conditions, thus allowing a further fractioning between deasphalted oil and resins.

It is advisable that the solvent of said deasphalting stage is chosen among the light paraffins having from 3 to 6 carbon atoms, preferably having from 4 to 5 carbon atoms, more preferably having 5 carbon atoms.

The second deasphalting stage (SDA2) performed by means of an extraction with a hydrocarbon, or not, solvent is generally carried out at temperatures from 40 to 160° C. and at a pressure from 1 to 60 Atm.

It is advisable to choose the solvent of said deasphalting stage from light paraffins having from 3 to 6 carbon atoms, preferably from 3 to 4 carbon atoms, more preferably having 3 carbon atoms.

The stream consisting of deasphalted oil (DAO) can be used in its current state as syncrude, possibly mixed with the distillates, or it can be used as a charge for the Catalytic Cracking processes with fluid bed of for Hydrocracking processes.

In the process according to the present invention there might be the presence of a further secondary section for the post-processing hydrogenation of the fraction $C_2$-500° C., preferably of the fraction $C_5$-350° C., coming out of the high-pressure separators provided before the distillation.

In said case, the stream containing the hydroprocessing reaction (HT1) product with the catalyst in the dispersed phase and/or the stream containing the product of the second hydroprocessing reaction (HT2) with the catalyst in the dispersed phase, before being sent to one or more distillation or flash stages undergo a pre-stage of separation, performed at high pressure, in order to obtain a light fraction and a heavy fraction, said heavy fraction being the only one sent to said stage or stages of distillation (D).

The light fraction obtained by the high pressure separation stage can be sent to a hydroprocessing section, thus producing a lighter fraction containing gas $C_1$-$C_4$ and $H_2S$ and a less light fraction containing hydroprocessed naphtha and diesel oil.

The possible introduction into the secondary section of hydrogenation post-processing of the fraction $C_2$-500° C., preferably the fraction $C_5$-350° C., exploits the availability of said fraction together with hydrogen at a relatively high pressure, which is the one of the hydroprocessing reactor, obtaining the following advantages:

starting from oil charges which are extremely with a high content of sulphur, it is possible to obtain fuels in line with the most severe sulphur content specifications (<10-50 ppm of sulphur) which are improved relative to other characteristics of the diesel fuel such as density, polyaromatic hydrocarbon content and cetane number;

the produced distillates do not have stability problems.

The fixed bed hydrogenation post-processing consists of the preliminary separation of the reaction effluent from the hydroprocessing reactor (HT1 and/or HT2) by means of one or more separators, which operate at high pressure and high temperature.

While the heavy part, extracted at the bottom, is sent to the main distillation unit, the part extracted from the head, a fraction C5-350° C., is sent to a secondary section of processing in presence of hydrogen, available at high pressure, in which the reactor is of the fixed bed type and contains a de-sulphuring/de-aromatizing catalyst in order to obtain a product with a highly reduced sulphur content and, at the same time, relative to the diesel fuel fraction, with increased cetane numbers. Normally, the hydroprocessing section consists of one or more reactors in series. The product of said system can then be further fractioned by distillation in order to obtain completely de-sulphured naphtha and diesel fuel according to the fuel specifications.

The fixed bed hydro-desulphuring stage for the hydro-desulphuring of the diesel fuels normally uses typical fixed bed catalysts; said catalyst, or a mixture of catalysts or a multiplicity of reactors with different catalysts having different properties, causes a deep refining of the light fraction, highly reducing the sulphur and nitrogen content, increasing the degree of hydrogenation of the charge, therefore decreasing the density and increasing the cetane number of the diesel fuel fraction, and at the same time decreasing the formation of coke.

Normally, the catalyst consists of an amorphous part basically consisting of alumina, silica, silica-alumina and of mixtures of various mineral oxides, on which (with various methods) a hydro desulphuring component together with a hydrogenising component are deposited. Typical catalysts for said operation are molybdenum or tungsten catalysts, with the addition of nickel and/or cobalt deposited on an amorphous mineral.

The hydrogenating post-processing reaction is performed at an absolute pressure slightly lower than that of the primary hydroprocessing stage, normally in the range from 7 to 14 MPa, preferably from 9 to 12 MPa. The hydro-desulphuring temperature is in the range from 250 to 500° C., preferably from 280 to 420° C. The temperature is normally a function of the required desulphuring level. The space speed is another important variable in order to control the quality of the obtained product. It may be from 0.1 to 5 $h^{-1}$, preferably from 0.2 to 2 $h^{-1}$.

The amount of hydrogen mixed with the charge is fed with a flow rate from 100 to 5000 $Nm^3/m^3$, preferably from 330 to 1000 $Nm^3/m^3$.

Another secondary post-processing section for the drainage stream can be present besides the possible secondary section of hydrogenation post-processing.

Said secondary section consists of the post-processing of the drainage stream in order to greatly reduce its entity and in order to recycle at least part of the still active catalyst to the hydroprocessing reactor.

In said case, the fraction of the stream containing asphaltenes, coming out of the second deasphalting section (SDA2) and called drainage stream, is sent to a processing section with an appropriate solvent to separate the product into a solid and into a liquid fraction from which said solvent can then be removed.

The possible section for processing the drainage effluent, preferably in an amount from 0.5 to 10% in volume relative to the fresh charge, consists of a deoiling stage by means of a solvent (toluene or diesel oil or other streams rich with aromatic compounds) and of a stage of separation of the solid fraction from the liquid one.

At least a part of said liquid fraction can be fed to:

- the "pool fuel oil", in its current state or after separation from the solvent and/or after the addition of an appropriate fluxing agent;
- and/or to the hydroprocessing reactor (HT1) and or to the second hydroprocessing reactor (HT2) in its current state.

In some specific cases the solvent and the fluxing agent may be the same substance.

The solid fraction can be disposed of in its current state, or, more conveniently, can be sent to a selective recovery process of the transition metal or metals contained in the transition catalyst (for instance molybdenum) (relative to the other metals contained in the starting residue, such as nickel and vanadium) and possibly there can be a recycle to the hydroprocessing reactor (HT1) and/or to the second hydroprocessing reactor (HT2) of the stream rich of transition metal (molybdenum).

Said composite process offers the following advantages in comparison to a traditional process:

- the amount of the drainage fraction is greatly reduced;
- a good part of the drainage fraction is upgraded to fuel oil by separating the metals and the coke;
- the fraction of fresh catalyst to be added to the charge under primary hydroprocessing is decreased, because at least a part of the molybdenum extracted by means of the selective recovery is recycled.

The deoiling stage consists of processing the drainage stream, which is a minimal fraction of the asphaltenic stream coming out of the second deasphalting section (SDA2) at the plant of primary hydroprocessing of the heavy charge, with a solvent capable to convert into a liquid phase the maximum possible quantity of organic compounds, leaving in solid phase the metal sulphides, the coke and the more refractory carbon residues ("insoluble toluene" and similar).

It is advisable to operate in an inert atmosphere, with as little oxygen and humidity as possible, because the metal nature components might become pyrophoric when very dry.

Different solvents can profitably be used in said deoiling stage. Among those we mention aromatic solvents such as toluene and/or mixtures of xylenes, hydrocarbon charges available in the plant as the fuel oil produced there or from the refinery, as, for instance, the Light Cycle Oil coming out of the FCC unit or the Thermal Gasoil coming out of the Visbreaker/Thermal Cracker unit.

The increases in temperature and in time of reaction speed up, within certain limits, the speed of the operation. Economic reasons do not allow an excessive increase.

The operational temperatures depend on the solvent used and on the pressure conditions; anyway, the advised temperatures are from 80 to 150° C.; the reaction times vary from 0.1 to 12 h, preferably from 0.5 to 4 h.

An important variable also to consider is the volumetric ratio solvent/drainage stream: it can vary from 1 to 10 (v/v), preferably from 1 to 5, more preferably from 1.5 to 3.5.

When the mixing phase between solvent and drainage stream is completed, the effluent, always under stirring, is sent to a stage of separation of the liquid phase from the solid one.

Said operation can be one of those typically used in industrial practice such as settling, centrifugation or filtration.

The liquid phase can then be sent to a phase of stripping and recovery of the solvent, which is recycled to the first stage (deoiling) of processing of the drainage stream. The remaining heavy fraction can profitably be used in the refinery as a charge, which is practically metal free with relatively low sulphur content. For instance, if the operation is performed with diesel oil, part of said diesel oil could be left in the heavy product in order to reach the specifications of "pool fuel oil".

Alternatively, the liquid phase can be recycled to the hydrogenation reactor.

The solid part can be disposed of in its current state or it can be subjected to a further process to selectively recover the catalyst (molybdenum) for recycling to the hydroprocessing treatment.

By adding to the above mentioned solid phase a heavy charge, without metals, such as, for mere example, part of the Deasphalted Oil (DAO2) coming out of the deasphalting unit of the plant itself and by mixing said system with acidulated water (typically with an inorganic acid), nearly all the molybdenum is maintained in the organic phase while substantial quantities of other metals migrate toward the aqueous phase. The two phases are easy to separate and the organic phase can then be profitably recycled to the hydroprocessing reactor (HT1) and/or to the second hydroprocessing reactor (HT2).

The solid phase is dispersed in a sufficient quantity of organic phase (for instance, deasphalted oil coming from the same process) to which acidulated water is added.

The ratio between the aqueous phase and the organic phase can vary from 0.3 to 3. The ph of the aqueous phase can vary from 0.5 to 4, preferably from 1 to 3.

Hereafter is described a realization of the present invention with the help of the attached FIG. 1, which, anyway, must not be considered as a limitation to the range of said invention.

In FIG. 1 the heavy charge (1) is sent to the deasphalting unit (SDA1). Said operation is performed by means of extraction with solvent.

From the deasphalting unit (SDA1) two streams are obtained: one (2) consisting of deasphalted oil (DAO 1), the other containing asphaltenes (3).

The stream consisting of deasphalted oil (2) is mixed with the fresh catalyst (initially) and with the make-up catalyst (5) (necessary to reintegrate the catalyst which is lost with the stream (19) as further described) and with the stream (20) (described further), coming out of the second deasphalting unit (SDA2), to form the stream (6) which is fed to the hydroprocessing reactor (HT1) into which hydrogen is introduced (or a mixture containing hydrogen and $H_2S$) (7).

Out of the reactor (HT1) comes a stream (8), containing the hydrogenation product and the catalyst in the dispersed phase, which is fractioned in a distillation or flash column (D).

The stream containing asphaltenes (3) is mixed with the fresh catalyst (initially) and sent to a second hydroprocessing reactor (HT2) out of which comes a product (16) fed to the distillation or flash column (D).

From said distillation or flash column (D) the lightest fractions (9) and the distillable products (10), (11) and (12) are separated from the distillation residue (13) containing the dispersed catalyst and the coke.

Said stream (13), called tar, is sent to a second deasphalting section (SDA2) from which two streams are obtained: one (17) consisting of deasphalted oil (DAO 2) and the other containing asphaltenes (18).

Said stream (18) (called tar), unless there is a drainage (19), is partly recycled as a stream (20) to the hydroprocessing unit (HT1) and partly as a stream (21) to the second hydroprocessing unit (HT2).

Hereafter are described some examples for the purpose of better illustrating the present invention, having understood that the present invention cannot be limited by or limited to the described examples.

Example 1

Following the scheme of FIG. 1 the following experiment was carried out:

Charge: 250 g vacuum residue from Ural crude oil (table 1)

Deasphalting agent: about 2.5 l of n-pentane

Temperature: 180° C.

Pressure: 16 atm

The vacuum residue together with a volume of n-pentane equal to 8-10 times the residue volume is loaded in an autoclave. The mixture of charge and solvent is heated to 180° C., stirring (800 rpm) with a mechanical impeller for a period of 30 minutes. At the end of the operation, settling takes place with the separation of the two phases: the asphaltenic one that settles on the bottom of the autoclave and the deasphalted oil phase diluted in the solvent. The settling lasts about two hours. By means of an appropriate recovery system the DAO-solvent phase is then transferred to a second tank. The DAO-pentane phase is then recovered, and then the solvent is eliminated by evaporation.

The return obtained applying the described process is equal to 82% of deasphalted oil relative to the starting vacuum residue.

The characteristics of the RV Ural charge and of the deasphalted oil (DAO C5) are described hereafter in Table 1:

TABLE 1

| | Characteristics of Ural 500° C. + Ural vacuum residue and of the extracted DAO n-C5 | | | | | | | |
|---|---|---|---|---|---|---|---|---|
| Charge | C (% w) | H (% p) | N (% w) | S (% w) | CCR (% w) | $d^{20}$ (g/cm$^3$) | V (ppm) | Ni (ppm) |
| RV URAL | 84.82 | 10.56 | 0.69 | 2.60 | 18.9 | 1.0043 | 262 | 80 |
| $DAOC_5$ | 85.40 | 11.40 | 0.43 | 2.33 | 9.78 | 0.9760 | 71 | 23 |

Example 2

Following the scheme of FIG. 1 the following experiment was carried out:

Stage of Charge Deasphalting (SDA)

Carried out according to the description of example 1.

Hydroprocessing Stage

Reactor: 3500 cc in steel equipped with magnetic stirring

Catalyst: 3000 ppm of Mo/charge added using an organic-metal oil-soluble precursor containing 15% w of metal Temperature: 430° C.

Pressure: 16 MPa of hydrogen

Time of residence: 3 h

Using the DAO produced by the deasphalting stage, some tests of hydroprocessing were carried out according to the process hereafter described. The reactor was loaded with the DAO together with the molybdenum compound and was pressurized with hydrogen. The reaction was carried out under the described operational conditions. After the completion of the test, the quenching was performed. The autoclave was depressurized and the gases collected in a sampling bag for a gaschromatography analysis. The liquid product present in the reactor was recovered and subjected to distillation, in such a way as to separate the 500° C.+residue from the other distillation cutters. The distillation residue (500° C.+), containing the catalyst, was reloaded in the reactor and mixed with an appropriate and previously prepared quantity of DAO C5, in such a way as to maintain constant the quantity of total charge. Said process was repeated until the quantity of the obtained residue was stabilized, in other words, until stationary conditions were reached.

Distillation Stage realized using laboratory equipment for the distillation of crude oil charges Deasphalting Stage for the Hydrogenated Residue (SDA2)

Charge: g hydrogenated distillation residue prepared in the previous step

Deasphalting agent: propane

Temperature: 85° C.

Pressure: 30 atm

The hydrogenated residue together with a volume of propane equal to 8 times the residue volume is loaded in an autoclave. The mixture of charge and solvent is heated up to 85° C., stirring (800 rpm) with a mechanical impeller for a period of 30 minutes. At the end of the operation, settling takes place separating the two phases: the asphaltenic one that settles on the bottom of the autoclave and the deasphalted oil phase diluted in the solvent. The settling lasts about two hours. By means of an appropriate recovery system the DAO-solvent phase is then transferred to a second tank. The propane is separated from DAO in gas phase, proceeding to depressurization of the tank via a valve. The deasphalted oil without solvent is then recovered, while the insoluble propane phase settles on the bottom of the loaded autoclave.

Results of the Experiment

Following the above described processes, 6 consecutive tests were carried out to hydroprocess the DAO 5 and subsequent deasphalting with propane and recycle of the phase which is insoluble in propane, containing molybdenum in the dispersed phase. The ratio between the recycled quantity and the quantity of fresh charge reached under said operational conditions was 0.38.

We indicate hereafter the data relative to the out coming streams after the last recycle (% in weight relative to the charge):

Gas: 4%

Naphtha ($C_5$-170° C.): 7%

Atmospheric diesel oil: (AGO, 170-350° C.): 31%

Vacuum diesel oil: (VGO, 350-500° C.): 36%

DAO C3: 22%

Table 2 illustrates the characteristics of the obtained product.

TABLE 2 characteristics of the reaction products obtained in test according to Example 2

| | Sulphur (% w) | Nitrogen (ppm) | Sp. Gr (g/cm$^3$) |
|---|---|---|---|
| Naphtha C5-170° C. | 0.03 | 290 | 0.7412 |
| AGO 170-350° C. | 0.10 | 1650 | 0.8437 |
| VGO 350-500° C. | 0.39 | 4120 | 0.9215 |

Example 3

Following the scheme of FIG. 1 the following experiment was carried out:

Stage of Hydroprocessing of the Asphaltenes (HT2)

The catalytic tests were carried out using a 30 cm$^3$ stirred micro-autoclave according to the following general operational procedure:

about 10 g of the charge are introduced in the reactor;

the system is then pressurized with hydrogen and heated to temperature by means of an electric oven;

during the reaction the system is stirred by a swinging capillary system operating at a rotation speed of 900 rpm; moreover, the total pressure is maintained constant by means of an automatic system of reintegration of the consumed hydrogen;

after the test is completed, the reaction quenching is performed; the autoclave is then depressurized and the gases collected in a sampling bag; the gas samples are then sent to a gaschromatography analysis;

the reaction product is recovered with tetrahydrofuran. Then the solution is filtered to separate the catalyst. The liquid fraction soluble in tetrahydrofuran, after the removal of the solvent is subjected to cold deasphalting by n-pentane, in order to separate the C5 asp haltenes. The fraction soluble in pentane is then analyzed, after removal of the solvent by evaporation.

The charge used for the experiment was prepared by mixing a fixed part of C5 asphaltenes produced in the example 1, depurated by possible solvent traces by an appropriate treatment in an oven, with an amount of DAO produced in example 2 by the deasphalting stage of the hydrogenated residue (SDA2). The mixture (1:1), containing the catalyst already dispersed in the DAO C3, was loaded in the reactor and subjected to a thermal treatment, after pressurization with hydrogen.

The reaction was carried out under the operational conditions shown in Table 3, in which the product distribution data is shown.

TABLE 3 characteristics of the reaction products of Example 3

| % w | 410° C.; 4 h | 420° C.; 3 h |
|---|---|---|
| Gas (C1-C4) | 2.6 | 3.2 |
| Naphtha C5-170° C. | 2.3 | 4.4 |
| AGO 170-350° C. | 14.7 | 17.1 |
| VGO 350-500° C. | 29.9 | 33.8 |
| DAO C5 | 35.9 | 31.2 |
| Asph. C5 | 14.6 | 10.3 |

The invention claimed is:

1. A process for the conversion of heavy charges selected from the group consisting of heavy crude oils, extra heavy crude oils, distillation residues, heavy oils from catalytic processes, thermal tars, bitumens from oil sands, coals of various nature, and black oils, by means of the joint use of at least three process units comprising a first deasphalting section (SDA1), a first hydroprocessing section (HT1), and a distillation or flash section (D), said process comprising:

sending the heavy charge to the first deasphalting section (SDA1) in the presence of one or more solvents and obtaining a first stream consisting of deasphalted oil (DAO 1 from (SDA1)) and a second stream consisting of asphaltenes;

mixing the first stream consisting of deasphalted oil (DAO 1 from (SDA1)) with a hydrogenation catalyst and sending the first obtained mixture to a first hydroprocessing section (HT1) and introducing into the first mixture hydrogen or a mixture comprising hydrogen and $H_2S$, thereby obtaining a first stream comprising a reaction product from the first hydroprocessing section (HT1) with the catalyst in the dispersed phase;

mixing the second stream consisting of asphaltenes with a hydrogenation catalyst and sending the second obtained mixture to a second hydroprocessing section (HT2) and introducing into the second mixture hydrogen or a mixture comprising hydrogen and $H_2S$, thereby obtaining a second stream comprising a reaction product from the second hydroprocessing section (HT2) with the catalyst in the dispersed phase;

sending both the first stream comprising the reaction product from the first hydroprocessing section (HT1) with the catalyst in the dispersed phase and the second stream comprising the reaction product from the second hydroprocessing section (HT2) with the catalyst in the dispersed phase, to one or more distillation or flash sections (D), wherein volatile fractions, including gases produced in the two hydroprocessing sections (HT1 and HT2), are separated from a distillation residue (tar) or from a liquid coming out of the flash section (D); and sending the distillation residue (tar) or the liquid coming out of the flash section (D), to a second deasphalting section (SDA2) in the presence of one or more solvents and obtaining a third stream consisting of deasphalted oil (DAO 2 (from SDA2)) and a fourth stream consisting of asphaltenes wherein, unless there is a drainage, a part of the third stream consisting of deasphalted oil is recycled to the hydroprocessing section (HT1) and a part of the fourth stream consisting of asphaltenes is recycled to the second first hydroprocessing section (HT2).

2. The process according to claim 1, where the weight ratio of the third stream consisting of deasphalted oil to the fourth stream consisting of asphaltenes is from 8/1 to 1/1.

3. The process according to claim 2, where the weight ratio of the third stream consisting of deasphalted oil to the fourth stream consisting of asphaltenes is from 4/1 to 2/1.

4. The process according to claim 3, where the weight ratio of the third stream consisting of deasphalted oil to the fourth stream consisting of asphaltenes is about 3/1.

5. The process according to claim 1, where the distillation in the one or more distillation sections (D) is performed at a pressure from 0.001 to 0.5 MPa.

6. The process according to claim 5, where the distillation in the one or more distillation sections (D) is performed at a pressure from 0.01 to 0.3 MPa.

7. The process according to claim 1, where the hydroprocessing in the first hydroprocessing section stage (HT1) is performed at a temperature from 380 to 470° C. and at a pressure from 3 to 30 MPa.

8. The process according to claim 7, where the hydroprocessing in the first hydroprocessing section stage (HT1) is performed at a temperature from 390 to 440° C. and at a pressure from 10 to 20 MPa.

9. The process according to claim 1, where the deasphalting in the first deasphalting section (SDA1) is performed at temperatures from 40 to 200° C. and at a pressure from 0.1 to 7 MPa.

10. The process according to claim 1, where the one or more solvents of the deasphalting in the first deasphalting section (SDA1) is a light paraffin with a number of carbon atoms from 3 to 6.

11. The process according to claim 1, where the one or more solvents of the deasphalting in the first deasphalting section (SDA1) is a light paraffin with a number of carbon atoms from 4 to 5.

12. The process according to claim 1, where the deasphalting in the first deasphalting section (SDA1) is performed by means of an extraction with a solvent operating in supercritical conditions.

13. The process according to claim 1, where the deasphalting in the first deasphalting section stage (SDA1) is performed with recovery of the solvent in supercritical phase.

14. The process according to claim 12 or 13, where the deasphalting in the first deasphalting section (SDA1) is performed at temperatures from 40 to 160° C. and at a pressure from 0.1 to 6 MPa.

15. The process according to claim 1, where the one or more solvents of the deasphalting in the second deasphalting section stage (SDA2) is a light paraffin with a number of carbon atoms from 3 to 6.

16. The process according to claim 15, where the one or more solvents of the deasphalting in the second deasphalting section (SDA2) is a light paraffin with a number of carbon atoms from 3 to 4.

17. The process according to claim 1, where the deasphalting in the second deasphalting section (SDA2) is performed with recovery of the solvent in supercritical phase.

18. The process according to claim 16 or 17, where the deasphalting in the second deasphalting section (SDA2) is performed at temperatures from 40 and 160° C. and at a pressure from 0.1 to 6 MPa.

19. The process according to claim 1, where the hydroprocessing in the second hydroprocessing section (HT2) is performed at a temperature from 360 to 450° C. and at a pressure from 3 to 30 MPa.

20. The process according to claim 19, where the hydroprocessing in the second hydroprocessing section (HT2) is performed at a temperature from 390 to 420° C. and at a pressure from 10 to 20 MPa.

21. The process according to claim 1, where the hydrogenation catalyst is an easily decomposable precursor or a preformed compound based on one or more transition metals.

22. The process according to claim 21, where the one or more transition metals is molybdenum.

23. The process according to claim 1, where the catalyst concentration in the first and second hydroprocessing sections (HT1 and HT2), defined according to the metal or metals present, is from 350 to 100000 ppm.

24. The process according to claim 23, where the catalyst concentration in the first and second hydroprocessing section (HT1 and HT2) is from 5000 to 30000 ppm.

25. The process according to claim 24, where the catalyst concentration in the first and second hydroprocessing sections (HT1 and HT2) is from 8000 to 15000 ppm.

26. The process according to claim 1, where the first and second hydroprocessing sections (HT1 and HT2) use the same hydrogenation catalyst.

27. The process according to claim 1, where the first stream comprising the reaction product from the first hydroprocessing section (HT1) with the catalyst in the dispersed phase and/or the second stream comprising the reaction product from the second hydroprocessing section (HT2) with the catalyst in the dispersed phase, before being sent to the one or more distillation or flash sections, is or are subjected to a separation pre-stage performed at high pressure to obtain a light and a heavy fraction, said heavy fraction only being sent to said one or more distillation sections (D).

28. The process according to claim 27, where the light fraction obtained from the high pressure pre-stage separation stage is sent to a secondary hydrogenation post-processing section thus producing a lighter fraction comprising gas $C_1$-$C_4$ and $H_2S$ and a less light fraction comprising hydroprocessed naphtha and fuel oil.

29. The process according to claim 28, where the hydrogenation post-processing reaction in the secondary hydrogenation post-processing section is performed at a pressure from 7 to 14 MPa.

30. The process according to claim 1, where a fraction of the fourth stream consisting of asphaltene from the second deasphalting section (DSA2) is sent to a processing section with a solvent to separate the product into a solid and a liquid phase from which said solvent can subsequently be separated, said processing section comprising a drainage processing section.

31. The process according to claim 30, where a drainage stream is in quantities from 0.5 to 10% in volume relative to the fraction of the fourth stream consisting of asphaltene sent to the processing section.

32. The process according to claim 30, where at least a part of the liquid phase coming out of the drainage processing section is sent in its current state or after separation from the solvent and/or after the addition of a fluxing agent to a fuel oil fraction.

33. The process according to claim 32, where at least a part of the liquid phase coming out of the drainage processing section is recycled to the second hydroprocessing section (HT2).

34. The process according to claim 30, where the solvent is an aromatic solvent or a mixture of fuel oils produced in said process or available in the refinery.

35. The process according to claim 34, where the aromatic solvent is toluene and/or a mixture of xylenes.

36. The process according to claim 30, where the volumetric ratio of the solvent to a drainage stream from the drainage processing section varies from 1 to 10.

37. The process according to claim 36, where the volumetric ratio varies from 1 to 5.

38. The process according to claim 37, where the volumetric ratio varies from 1.5 to 3.5.

39. The process according to claim 21, where a solid fraction of the processed product is sent to a further process of selective recovery of the one or more transition metals contained in the hydrogenation catalyst.

40. The process according to claim 39, where the recovered one or more transition metals are recycled to the first hydroprocessing section (HT1) and/or to the second hydroprocessing section (HT2).

* * * * *